US010047580B2

(12) United States Patent
Morgan et al.

(10) Patent No.: US 10,047,580 B2
(45) Date of Patent: Aug. 14, 2018

(54) TRANSVERSE SIDEWALL CORING

(71) Applicant: Baker Hughes Incorporated, Houston, TX (US)

(72) Inventors: Christopher John Morgan, Spring, TX (US); Hermnus J. Nieuwoudt, Tomball, TX (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 460 days.

(21) Appl. No.: 14/664,347

(22) Filed: Mar. 20, 2015

(65) Prior Publication Data

US 2016/0273292 A1 Sep. 22, 2016

(51) Int. Cl.

| | |
|---|---|
| ***E21B 10/02*** | (2006.01) |
| ***E21B 25/10*** | (2006.01) |
| ***E21B 49/06*** | (2006.01) |

(52) U.S. Cl.

CPC ..... *E21B 25/10* (2013.01); *E21B 10/02* (2013.01); *E21B 49/06* (2013.01)

(58) Field of Classification Search

CPC ..... E21B 25/10; E21B 49/06; E21B 10/12
See application file for complete search history.

(56) References Cited

U.S. PATENT DOCUMENTS

| | | | | |
|---|---|---|---|---|
| 3,272,268 | A | 9/1966 | Tricon et al. | |
| 3,776,321 | A | 12/1973 | Wolk | |
| 4,280,568 | A | 7/1981 | McPhee et al. | |
| 4,466,495 | A * | 8/1984 | Jageler | E21B 49/06 175/59 |
| 4,714,119 | A | 12/1987 | Hebert et al. | |
| 5,310,013 | A | 5/1994 | Kishino et al. | |
| 5,439,065 | A | 8/1995 | Georgi | |
| 5,487,433 | A | 1/1996 | Mackay et al. | |
| 5,667,025 | A | 9/1997 | Haessly et al. | |
| 7,303,011 | B2 | 12/2007 | Reid et al. | |
| 7,347,284 | B2 | 3/2008 | Arian et al. | |
| 7,500,388 | B2 | 3/2009 | Fujisawa et al. | |
| 7,530,407 | B2 | 5/2009 | Tchakarov et al. | |
| 7,958,936 | B2 | 6/2011 | McGregor et al. | |
| 8,061,446 | B2 | 11/2011 | Reid, Jr. et al. | |
| 8,292,004 | B2 | 10/2012 | Buchanan et al. | |

(Continued)

OTHER PUBLICATIONS

International Preliminary Examination Report dated Sep. 26, 2017 for corresponding PCT/US2016/022260.

*Primary Examiner* — Nicole Coy
*Assistant Examiner* — Brandon M Duck
(74) *Attorney, Agent, or Firm* — Bracewell LLP; Keith R. Derrington

(57) ABSTRACT

A system and method of gathering sample cores from a subterranean formation with coring bit assemblies, where each of the coring bit assemblies retain a sample core within. Included is a container equipped with compartments for individual storage of each coring bit assembly and coring sample, so that each sample can be stored at the pressure at which it was obtained. The coring bit assemblies can be sequentially inserted into the container after being used to collect its sample core. In this instance, scaling devices, such as o-ring seals or a coining surface, are provided in the container. Bach coring bit assembly can also be disposed in a chamber, that is selectively scaled after the coring bit assembly gathers its coring sample.

19 Claims, 9 Drawing Sheets

(56) References Cited

U.S. PATENT DOCUMENTS

| | | | | |
|---|---|---|---|---|
| 8,430,186 | B2 | 4/2013 | Reid, Jr. et al. | |
| 8,621,920 | B2 | 1/2014 | Reid et al. | |
| 2006/0054358 | A1* | 3/2006 | Hill | E21B 49/06 175/58 |
| 2011/0094801 | A1 | 4/2011 | Buchanan et al. | |
| 2013/0233622 | A1 | 9/2013 | Reid et al. | |
| 2015/0021096 | A1 | 1/2015 | Wesemeier et al. | |

* cited by examiner 32
38
34
36
12
18
10
16
20
26
24
14
30
28 1-n
22

TRANSVERSE SIDEWALL CORING

BACKGROUND OF THE INVENTION

1. Field of Invention

The present disclosure relates to a system and method for obtaining core samples from a sidewall of a wellbore where each core sample is stored at the pressure at which it was obtained.

2. Description of Prior Art

Production of hydrocarbons typically involves excavating a borehole from the Earth's surface, through the underlying subterranean formation, and that, intersects a hydrocarbon bearing reservoir downhole. To aid in identifying hydrocarbon bearing locations, sample cores are sometimes obtained from a sidewall of the borehole, which is generally referred to as coring. The step of coring often employs a coring tool having a side coring bit that is rotatable and can be urged radially outward from the coring tool. The coring bit is usually made up of a sleeve having a cutting surface on of its end that is projected outward from the tool. Thus sample cores can be gathered by rotating the coring bit while urging it against the sidewall, thereby cutting a sample away from the formation that is collected within the sleeve. The end of the sample adjacent the cutting surface breaks away from the rest of the formation so that the coring sleeve with sample inside can be drawn back into the coring tool. Often multiple core samples are obtained with a single trip downhole of the coring tool. Typical practice is to eject the multiple core samples together into a single storage area.

SUMMARY OF THE INVENTION

Disclosed herein is an example of a system for obtaining core samples from a sidewall of a wellbore, that in one embodiment includes a housing, spaces in the housing, pressure barriers selectively disposed between the spaces so that a pressure in each of the spaces is maintained at a particular value, and a coring bit assembly disposed in each one of the spaces. Each of the coring bit assemblies include a sleeve that selectively receives a one of the core samples and a cutting head on an end of the sleeve that selectively is projected from the housing and into cutting engagement with the sidewall. A coring driver can be included in the housing that selectively engages an end of the sleeve distal from the cutting head. In this example, the coring driver is selectively movable axially within the housing. In one alternative, the coring bit assemblies are arranged in a row that extends axially within the housing, and wherein the coring bit assemblies are moveable axially with respect to the coring driver. The system may further include a cylindrically shaped riser member in the housing, wherein the spaces are formed in the riser member, and wherein the coring bit assemblies with core samples are selectively disposed in the spaces. In this example, the riser member is made of a tubular with an axis that is substantially parallel with an axis of the housing and has planar barriers provided between each adjacent coring bit assembly and that span across an inner circumference of the tubular to define pressure barriers. Further included with the riser member are rear openings through which a coring driver is selectively inserted and forward openings through which coring bit assemblies project through when the cutting head is in cutting engagement with the sidewall. This embodiment can further have a container in which the riser member is selectively coaxially inserted, the container comprising an inner circumference with o-ring seals strategically located thereon, so that when the riser member is inserted into the container, at least one of the o-ring seals is between adjacent rear openings and adjacent forward openings. In an example, the riser member is made up of a substantially solid cylindrical member having chambers transversely formed therein that are selectively pressure isolated from one another and wherein a one of the coring bit assemblies is disposed in each of the chambers. This example can further have a piston coaxially mounted in each of the chambers, and seals between the pistons and inner surfaces of the chambers that define a pressure barrier, wherein each of the pistons is coupled with an end of a coring bit assembly, so that when a coring bit assembly drive rotatingly and longitudinally motivates a one of the pistons, an attached coring bit assembly is urged out of the respective chamber and into coring engagement with the sidewall. Apertures may be included that are in a sidewall of the housing and through which the coring bit assemblies are inserted through, and a capping system having covers that are scalingly mounted over the apertures so that the space is pressure sealed. Further optionally included is a container with a metal inlay disposed axially along a sidewall of the container, wherein the coring bit assemblies are disposed into the container so that the cutting heads are in sealing contact with the metal inlay, wherein the metal inlay is formed from a material having a yield strength that is less than a yield strength of a material making up the cutting heads, and wherein the spaces are formed as the cutting heads are urged into sealing contact with the metal inlay. In one embodiment a cap is inserted into an open end of the sleeve to define a pressure seal for an inside of the sleeve, the cap having a circular base and walls circumscribing the base that project axially away from the base and abut an inward facing surface of the cutting head. The system can optionally further include a cap inserted into an open end of the sleeve to define a pressure seal for an inside of the sleeve, where the cap is made up of a circular base and waits circumscribing the base that project axially away from the base and are threadingly coupled with an inner circumference of the cutting head. In an example, the particular value is substantially the same as a value of pressure in a subterranean formation from which the core sample was obtained.

Another example of a system for obtaining core samples from a sidewall of a wellbore includes a housing, spaces formed in the housing that are selectively maintained at different pressures, and a coring bit assembly in each one of the spaces, each of the coring bit assemblies having an annular cutting head and a sleeve having an open end coaxially affixed with the cutting head, so that when the cutting head is rotatingly and longitudinally urged into cutting contact with subterranean formation at the sidewall, a core sample is formed and deposited into the sleeve and maintained in the sleeve at a pressure that is substantially the same as a pressure of the subterranean formation from which the core sample was taken. The spaces can be formed in an annular riser member that is disposed in the housing, wherein the riser member includes a tubular with planar pressure barriers, wherein the spaces are defined between adjacent barriers. Optionally, the spaces are formed in an annular riser member that is disposed in the housing, and wherein the riser member is a substantially solid cylinder with chambers transversely formed through the riser member. Pistons may be included with this embodiment, where the pistons are coaxially disposed in the chamber that couple with an end of each coring bit assembly, and seals between the circumference of each piston and an inner wall of each chambers, so that by rotatingly and longitudinally motivating a one of the pistons, a corresponding coring bit assembly is put into coring engagement with the sidewall for retrieval of a coring sample. In an example, the spaces are formed by sealing an open end of each of the sleeves with a cap.

Also disclosed herein is an example of a method of obtaining core samples from a sidewall of a wellbore and which includes providing a coring system that is made up of a housing and coring bit assemblies, each coring bit assembly having a cutting head and a sleeve. The method can further include using a one of the coring bit assemblies to gather a core sample, storing the one of the coring bit assemblies and the core sample in the housing at a particular pressure, using another one of the coring bit assemblies to gather another core sample, and storing the another one of the coring bit assemblies and the another core sample in the housing at another particular pressure. The one of the coring bit assemblies and the another one of the coring bit assemblies can be stored in an elongated riser member. This example can further include inserting the elongated riser member into a container, and strategically providing seals at axial locations between the riser member and container, so that spaces formed transversely through the riser member are pressure isolated from one another. Alternatively, the one of the coring bit assemblies and the another one of the coring bit assemblies can be disposed in chambers transversely formed through the riser member, the method may further involve providing pistons in ends of the chambers, coupling the pistons respectively to one of the coring bit assemblies and the another one of the coring bit assemblies, selectively rotating and longitudinally urging a one of the pistons to obtain a core sample. In an embodiment, the step of storing includes sealing open ends of the coring bit assemblies with caps.

BRIEF DESCRIPTION OF DRAWINGS

Some of the features and benefits of the present invention having been stated, others will become apparent as the description proceeds when taken in conjunction with the accompanying drawings, in which.

Figure 1:
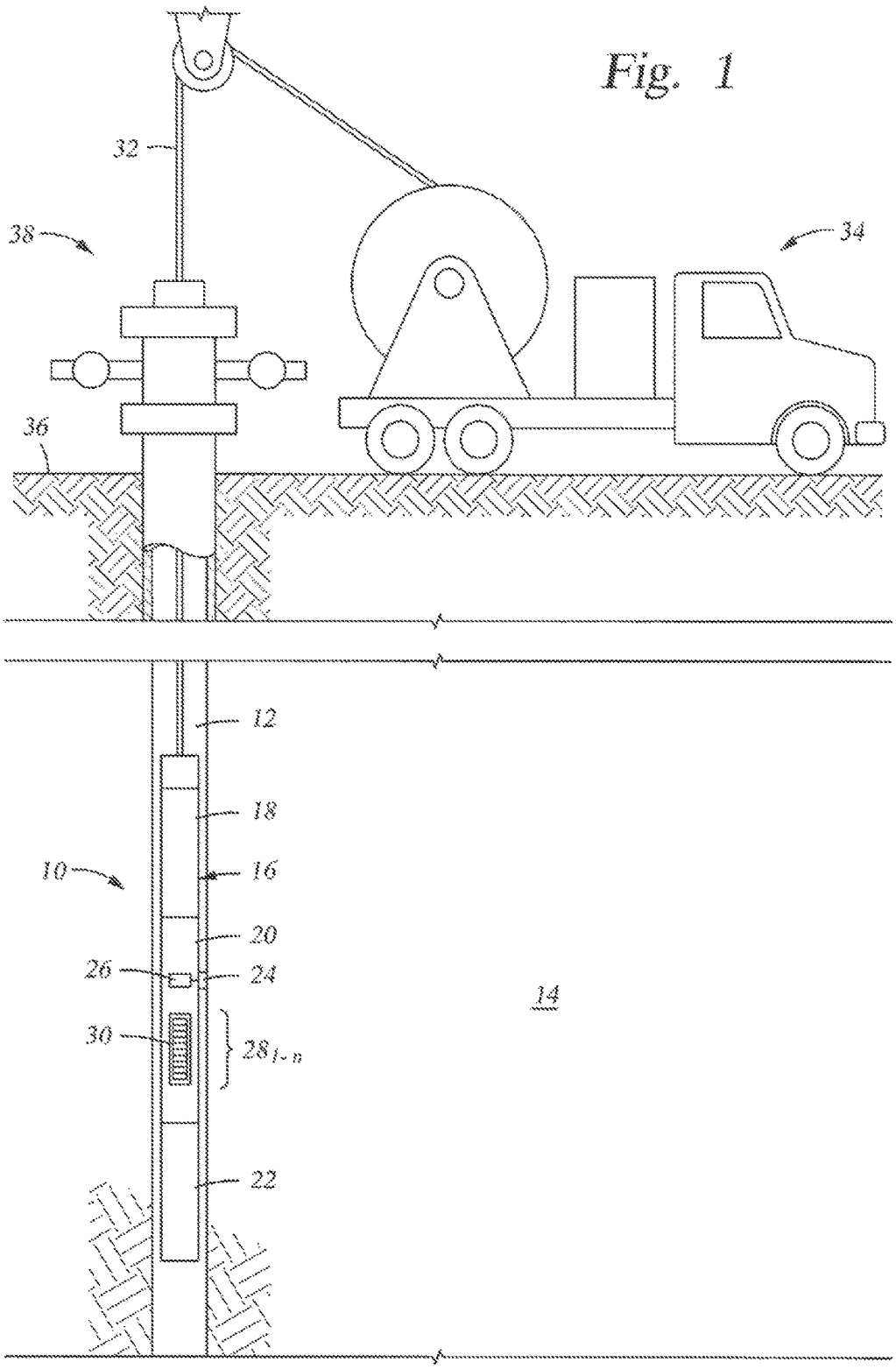
FIG. 1 is a side sectional view of an example of a coring system disposed in a wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes 5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 shows in a side partial sectional view one example of a coring system 10 disposed in a wellbore 12, where wellbore 12 intersects a subterranean formation 14. Coring system 10 includes a main body with an outer housing 16. Included within housing 16 is a power unit 18 and a coring section 20 adjacent power unit 18. A lower section 22 is shown on an end of coring section 20 distal from power unit 18. In the example of FIG. 1, the coring system 10 includes a coring bit assembly 24, which is shown being driven by a coring bit assembly driver 26 to obtain sample cores 28 from a sidewall of wellbore 12 and from formation 14. Embodiments exist where the power unit 18 includes power sources, such as batteries, hydraulic sources, or other forms of energizing the coring bit assembly driver 26. In one alternative, a storage container 30 is shown within housing 16 and where sample cores $\mathbf{281}_{1-n}$ are optionally stored. One example, each of the sample cores $\mathbf{281}_{1-n}$ is stored at a pressure that is different from a pressure at which another one of the sample cores $\mathbf{281}_{1-n}$ is stored. Examples exist wherein the pressure at which the sample cores $\mathbf{281}_{1-n}$ are stored at substantially the same pressure within formation 14 from where they were obtained.

A wireline 32 is shown being used for deploying the coring system 10 within wellbore 12, however, any other deployment means to be used with coring system 10, such as coiled tubing, slick line, drill pipe, cable, and the like. Further, a surface truck 34 is shown provided at surface 36 for selectively raising and lowering wireline 32 and for deploying coring system 10. Wireline 32 is shown being inserted through a wellhead assembly 38 that mounts on an upper open end of wellbore 12 at surface 36. Further optionally, the storage container 30 may be selectively moved from within coring section 20 and into lower section 22.

Figure 2A:
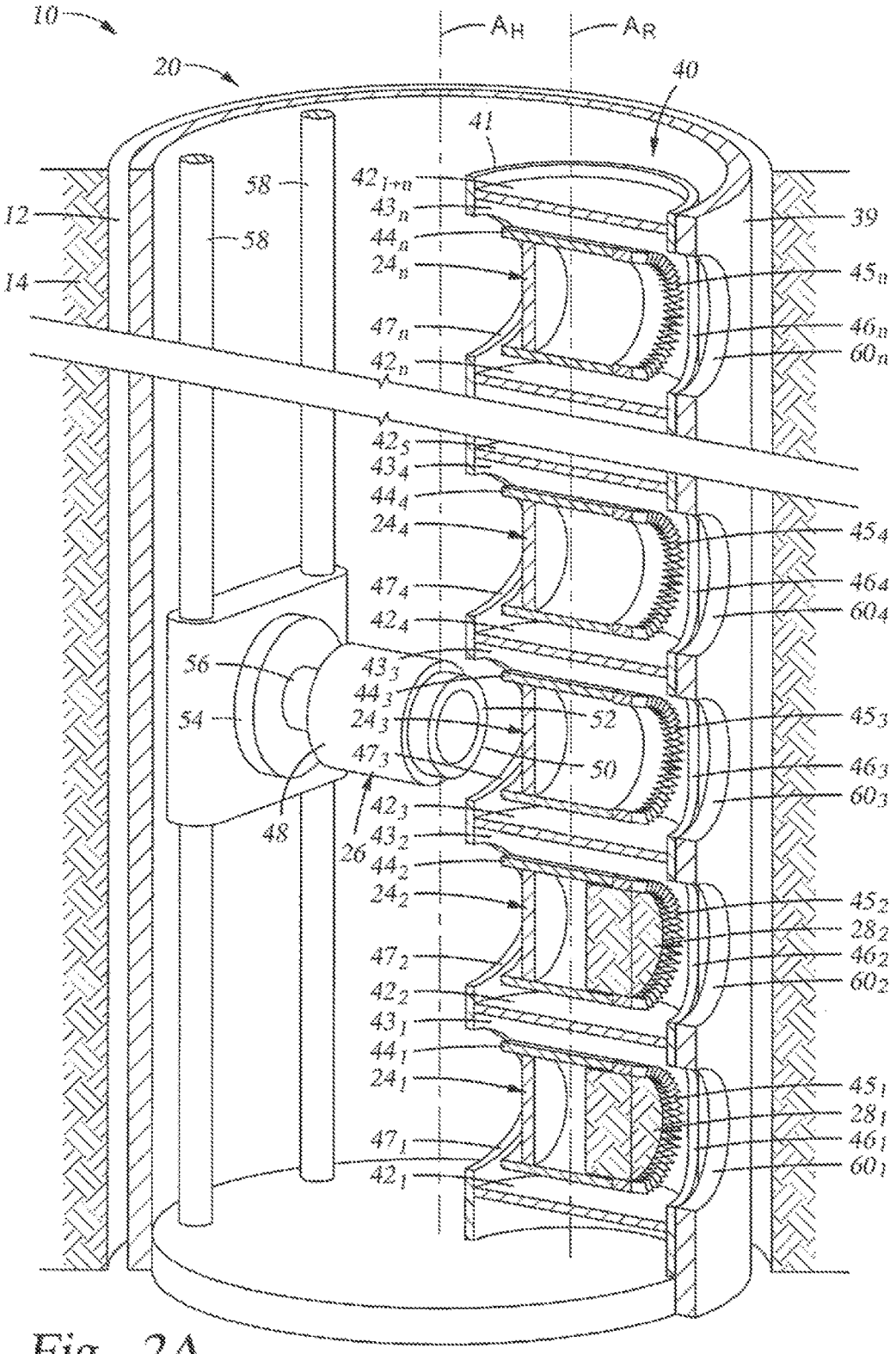
FIGS. 2A and 2B are side perspective and partial sectional views of an example of obtaining a core sample with the coring system of FIG. 1.

FIG. 2A shows in perspective side partial sectional view one example of a portion of coring section 20 of the coring system 10. In this example, coring section 20 includes an outer housing 39 which provides a covering and protection for components of the coring section 20. Here, coring bit assemblies $\mathbf{241}_{1-n}$ are shown provided within a riser member 40; in this example an axis $A_R$ of riser member 40 is shown substantially parallel and radially offset with an axis $A_H$ of housing 39. Alternate examples exist wherein riser member 40 is canted within housing 39 such that axis $A_R$ is oblique with respect to axis $A_H$. Riser member 40 of FIG. 2A includes a tubular 41 member having a diameter less than the diameter of housing 39 and is asymmetrically offset within housing 39. Between adjacent ones of the coring bit assemblies $\mathbf{241}_{1-n}$ are planar barriers $\mathbf{42}_1$-$\mathbf{42}n_{+1}$. Barriers $\mathbf{42}_1$-$\mathbf{42}n_{+1}$ span across the entire inside of the tubular 41 to define spaces $\mathbf{43}_{1-n}$ therebetween. It is within the spaces $\mathbf{43}_{1-n}$ where the coring bit assemblies $\mathbf{24}_{1-n}$ are provided. Each of the coring bit assemblies $\mathbf{24}_{1-n}$ include an annular sleeve $\mathbf{44}_{1-n}$, each of which have a closed end and an open end; where a cutting head $\mathbf{45}_{1-n}$, is provided at the open end. In the example of the FIG. 2A, coring bit assemblies $\mathbf{24}_{1-2}$ are shown each having a core sample $\mathbf{28}_1$, $\mathbf{28}_2$ disposed within their respective sleeves $\mathbf{44}_1$, $\mathbf{44}_2$. Forward openings $\mathbf{46}_{1-n}$ are provided within the sidewall of the tubular 41 to allow the respective coring bit assemblies $\mathbf{24}_{1-n}$ to be urged radially outward from within the tubular 41. Similarly, rearward openings $\mathbf{47}_{1-n}$ are provided through a sidewall of the tubular 41, opposite from associated forward openings $\mathbf{46}_{1-n}$; wherein die rear openings $\mathbf{47}_{1-n}$ provide a pathway for the coring bit assembly driver 26 to selectively engage one of the coring bit assemblies $\mathbf{24}_{1-n}$.

Coring bit assembly driver 26 includes a body 48 and a drive attachment 50. Body 48 is depicted as a generally cylindrical member, and drive attachment 50 is shown provided on an end distal from the riser member 40. A drive surface 52 is provided on an outermost portion of drive attachment 50 that can be profiled for selective coupling with one of the coring bit assemblies $\mathbf{24}_{1-n}$. Although not shown, the profiles can resemble teeth, gears, or any other type of elements or projections wherein rotational force from one body can be transferred to another. Coring bit assembly driver 26 is shown further including a drive member 54 that couples with drive attachment 50 via an elongated drive shaft 56. Examples exist where drive member 54 is a motor driven by an electrical power source (not shown) or can be hydraulically driven to provide rotational and longitudinal motivation to the body 48 and drive attachment 50. For example, the drive member 54 can be energized from a power source disposed in power unit 18 (FIG. 1). Moreover, elongated tracks 58 are shown disposed within housing 39 that extend axially and proximate an inner surface of housing 39. Coring bit assembly driver 26 is axially moveable within housing 39 and along tracks 58. Alternate embodiments exist, wherein coring bit assembly driver 26 remains within its axial location within housing 39, and selective ones of the coring bit assemblies $\mathbf{24}_{1-n}$ are moved axially into a position adjacent the coring bit assembly driver 26. In one example, the riser member 40 is moved axially to selectively position the coring bit assemblies $\mathbf{24}_{1-n}$. Further provided in FIG. 2A are apertures $\mathbf{60}_{1-n}$ that are formed radially through a sidewall of housing 39. As will be described in more detail below, when apertures $\mathbf{60}_{1-n}$ register with forward openings $\mathbf{46}_{1-n}$, selected one or more of the coring bit assemblies $\mathbf{24}_{1-n}$ may be inserted through their respective forward openings $\mathbf{46}_{1-n}$ and aperture $\mathbf{60}_{1-n}$ and into coring engagement with the formation 14.

Figure 2B:
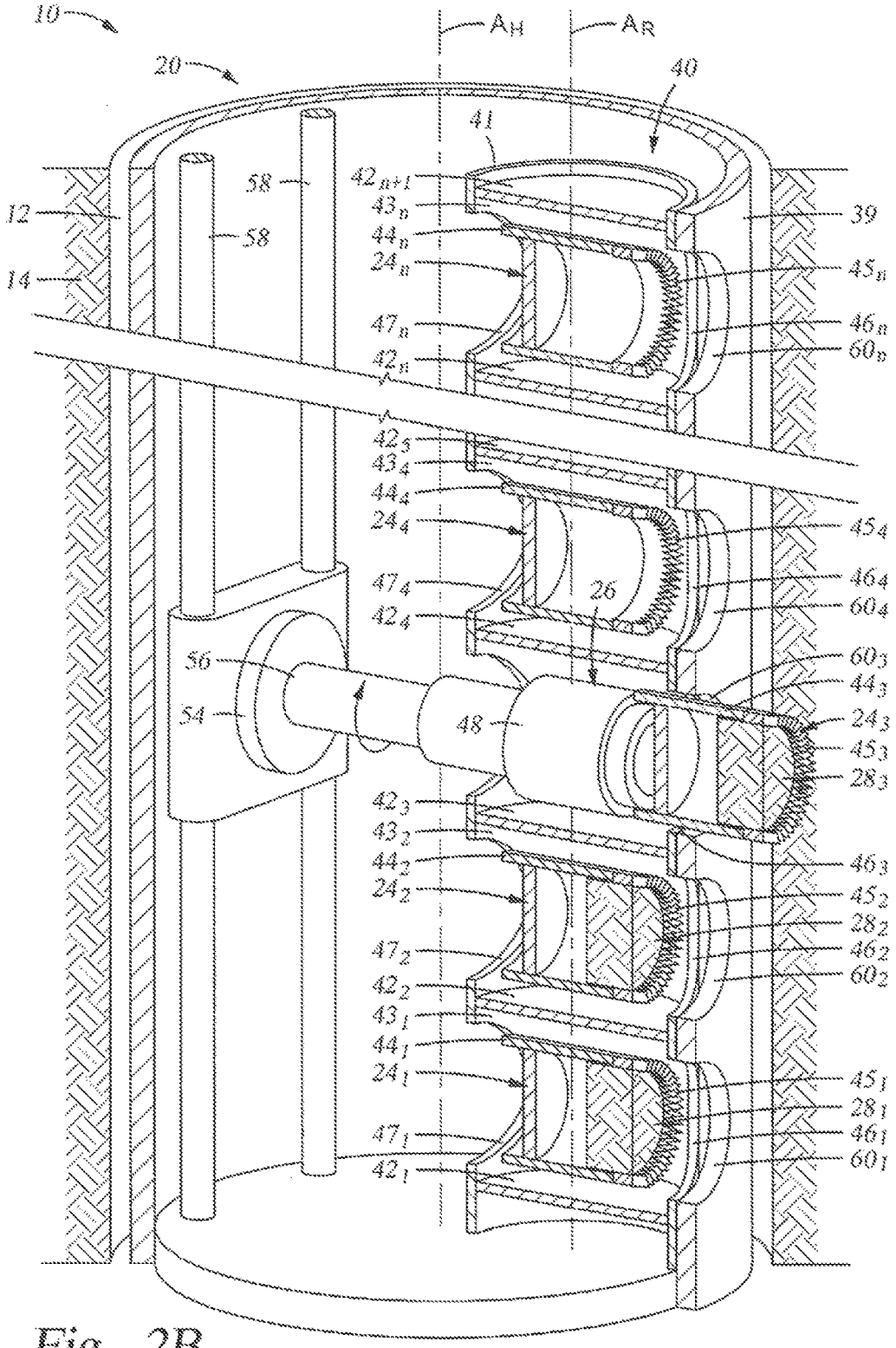

Shown in FIG. 2B is one example of obtaining a sample core $\mathbf{28}_3$ from formation 14. Here, coring bit assembly driver 26 is disposed on tracks 58 at a selected axial location within housing adjacent coring bit assembly $\mathbf{24}_3$ and oriented for coring engagement with coring bit assembly $\mathbf{24}_3$. Here, drive shaft 56 is extended radially away from drive member 54 so that the cutting head $\mathbf{45}_3$ is being rotated and pushed against formation 14 to cut away rock in the formation. Continued radial pushing of coring bit assembly $\mathbf{24}_3$, combined with its rotation, cuts away a cylindrically shaped sample core $\mathbf{28}_3$ that is drawn within can gathered within sleeve $\mathbf{44}_3$. Further, as indicated above, sleeve $\mathbf{44}_3$ and cutting head $\mathbf{45}_3$ have been inserted through the forward end $\mathbf{46}_3$ and the registered aperture $\mathbf{60}_3$. After obtaining the core $\mathbf{28}_3$, the coring bit assembly driver 26 can return to its configuration of FIG. 2A, moved axially along tracks 58, and another one of the coring bit assemblies $\mathbf{24}_{4-n}$ can be engaged to obtain additional sample cores. As will be described in further detail below, alternatives exist wherein the particular sample core $\mathbf{28}_{1-n}$ is selectively stored at a particular pressure. Either by sealing the coring bit assembly $\mathbf{28}_{1-n}$ within the riser member 40, or inserting the riser member 40 within a containment-type vessel that then provides sealing of the coring bit assemblies $\mathbf{24}_{1-n}$ with their respective cores $\mathbf{28}_{1-n}$ at live designated pressures.

Figure 3:
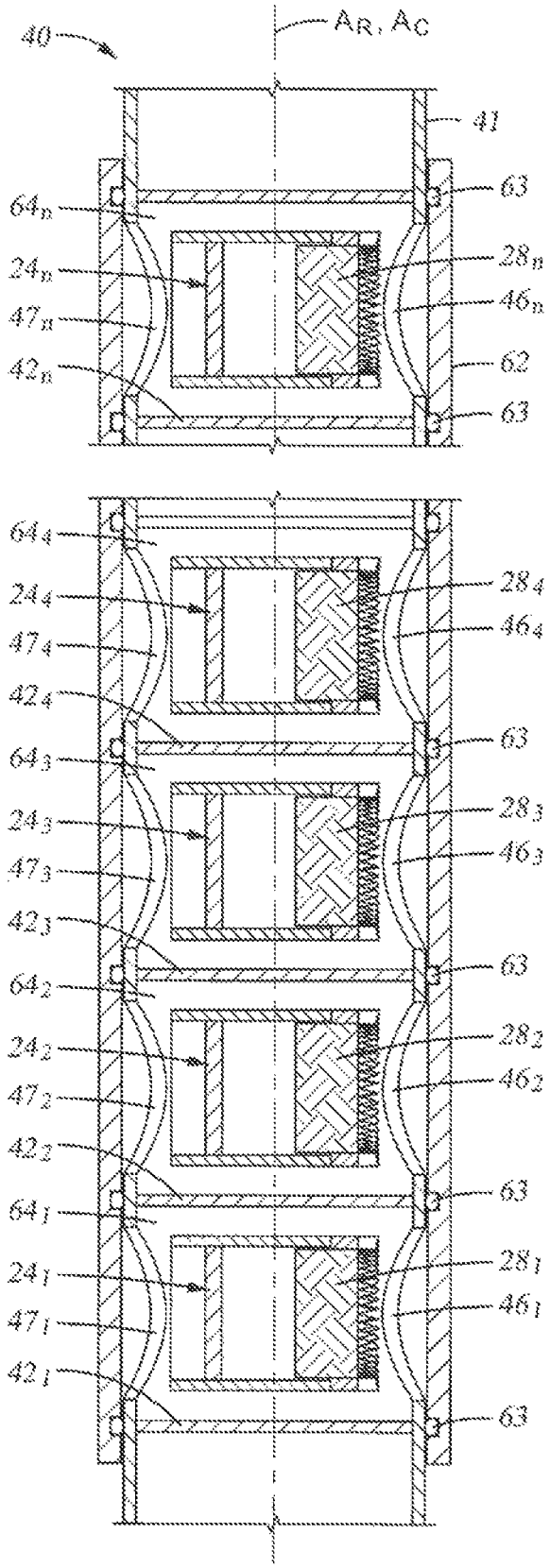
FIG. 3 is a perspective view of an example of core sleeves with core samples being stored in a sealed container.

In the example of FIG. 3, riser member 40 is inserted within an annular container 62. In this example, O-ring seals 63 are shown provided at strategic locations along an axis $A_C$ of container 62 and between adjacent ones of openings $\mathbf{46}_{1-n}$, and $\mathbf{47}_{1-n}$. As such, containment spaces $\mathbf{64}_{1-n}$ are formed so that the respective sample cores $\mathbf{28}_{1-n}$ can be stored at a pressure at which they were obtained. In one example of operation, coring bit assembly $\mathbf{24}_1$ is the first one of the coring bit assemblies $\mathbf{24}_{1-n}$ to be used for obtaining its respective sample core $\mathbf{28}_1$. Prior to obtaining additional sample cores, tubular 41 is inserted into container 62 far enough so that an uppermost one of the O-ring seals 64 is between openings $\mathbf{46}_1$, $\mathbf{47}_1$ and openings $\mathbf{46}_2$, $\mathbf{47}_2$. As such, a sealed space $\mathbf{64}_1$ is formed within the tubular 41 between barrier $\mathbf{42}_1$ and barrier $\mathbf{42}_2$. And in the volume of space that surrounds coring bit assembly $\mathbf{24}_1$ and its sample core $\mathbf{28}_1$. Accordingly, as uppermost of the coring bit assemblies $\mathbf{24}_{2-n}$ are engaged to obtain a corresponding core sample $\mathbf{28}_{2-n}$, the tubular 41 may be sequentially urged farther within container 62 and thereby forming additional sealed spaces $\mathbf{64}_{2-n}$ as illustrated in FIG. 3. In this manner, the individual sealed spaces $\mathbf{64}_{1-n}$ may be at a pressure that is substantially the same as a pressure in the formation 14 (FIG. 1) at which the sample cores $\mathbf{28}_{1-n}$ were obtained, in one example pressure in sealed space $\mathbf{64}_3$ is substantially the same as the pressure in formation 14 from where sample core $\mathbf{28}_3$ was gathered. Further shown in the example of FIG. 3 is that the tubular 41 is substantially coaxial with container 62, so that axes $A_R$, $A_C$ substantially occupy the same space.

Figure 4A:
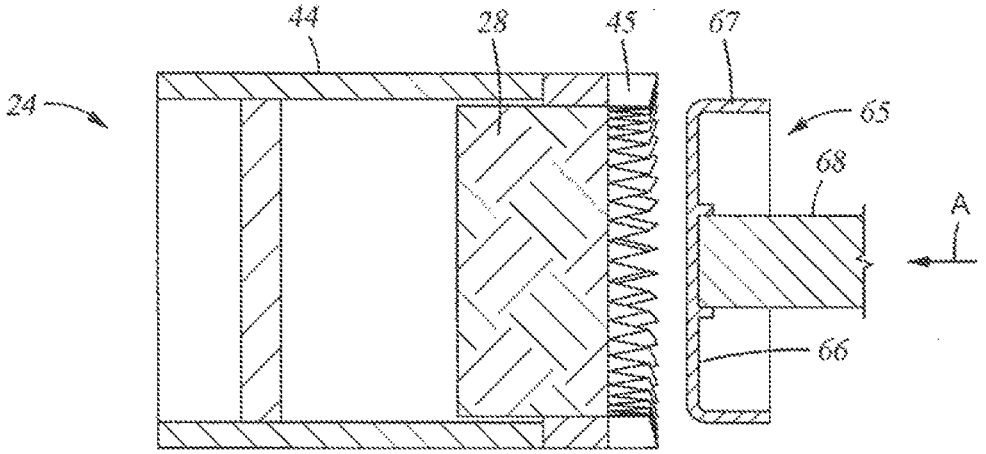
FIGS. 4A and 4B are side sectional views of an example of sealing an open end of a coring sleeve with a cap, and where a core sample is in the coring sleeve.
Figure 4B:
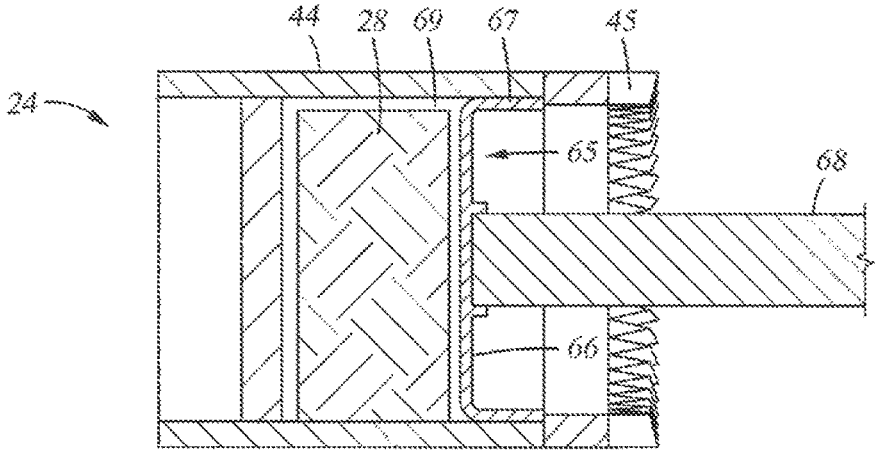
Figure 5:
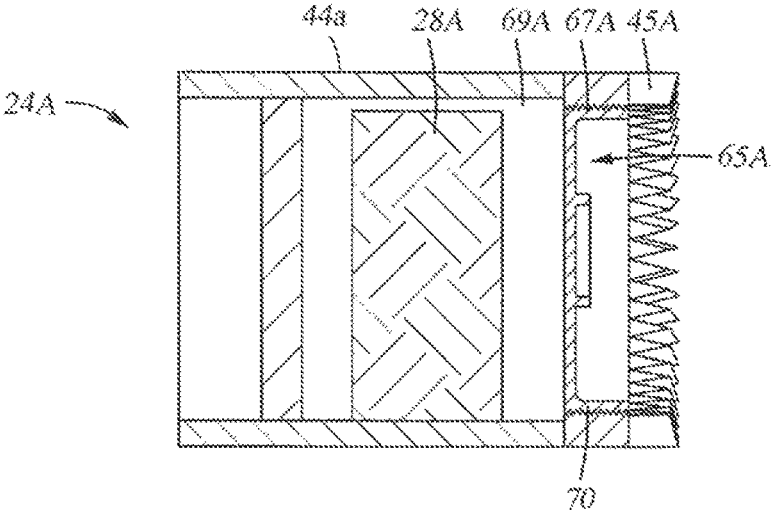
FIG. 5 is a side sectional view of an example of sealing an open end of a coring sleeve with a threaded cap, and where a core sample is in the coring sleeve.

Referring now to FIGS. 4A and 4B, shown in a side sectional view is one example of securing a cap 65 to an open end of a sleeve of a coring bit assembly 24 after a core sample 28 has been collected and disposed in the sleeve 44. In this example, cap 65 includes a disk-like base 66 with a curved outer periphery, and walls 67 that project axially away from the outer periphery of base 66. In the example of FIG. 4A, the walls 67 are directed away from the open end of sleeve 44. A rod 68 is shown applied to base 66 and used for urging cap 65 in the direction of arrow A and towards the open end of sleeve 44. As the cap 65 is urged past the cutting head 45, the force applied by rod 68 on base 66 causes flexing of cap 65 so that it may be inserted past the inner circumference of cutting head 45. Ultimately, the walls 67 extend past the inside of cutting head 45 and so that the walls 67 abut the inward lacing surface of cutting head 45. The configuration of FIG. 4B illustrates a cap 65 that provides a seal on the open end of sleeve 44 thereby defining a sealed space 69 within sleeve 44, which is one optional way of individually pressure sealing the sample core 28. It is well within the capability of those skilled in the art to create a means for urging rod 68 against cap 65 to provide the sealing capabilities of the cap 65. It is to be understood that this method of sealing illustrated in FIGS. 4A and 4B may be applied to one or more of the coring bit assemblies $\mathbf{24}_{1-n}$ (FIG. 2A). In an alternate embodiment shown in FIG. 5, cap 65A may have threads on an outer circumference that mate with threads on an inner surface of the cutting head 45. In this configuration, threadingly attaching cap 65A to cutting head 45A defines a threaded connection 70 between cap 65A and cutting head 45A and creates a sealed space 69A within sleeve 44A. In these examples, sealed spaces 69, 69A can be at substantially the same pressure at which the corresponding core sample 28 was obtained.

Figure 6:
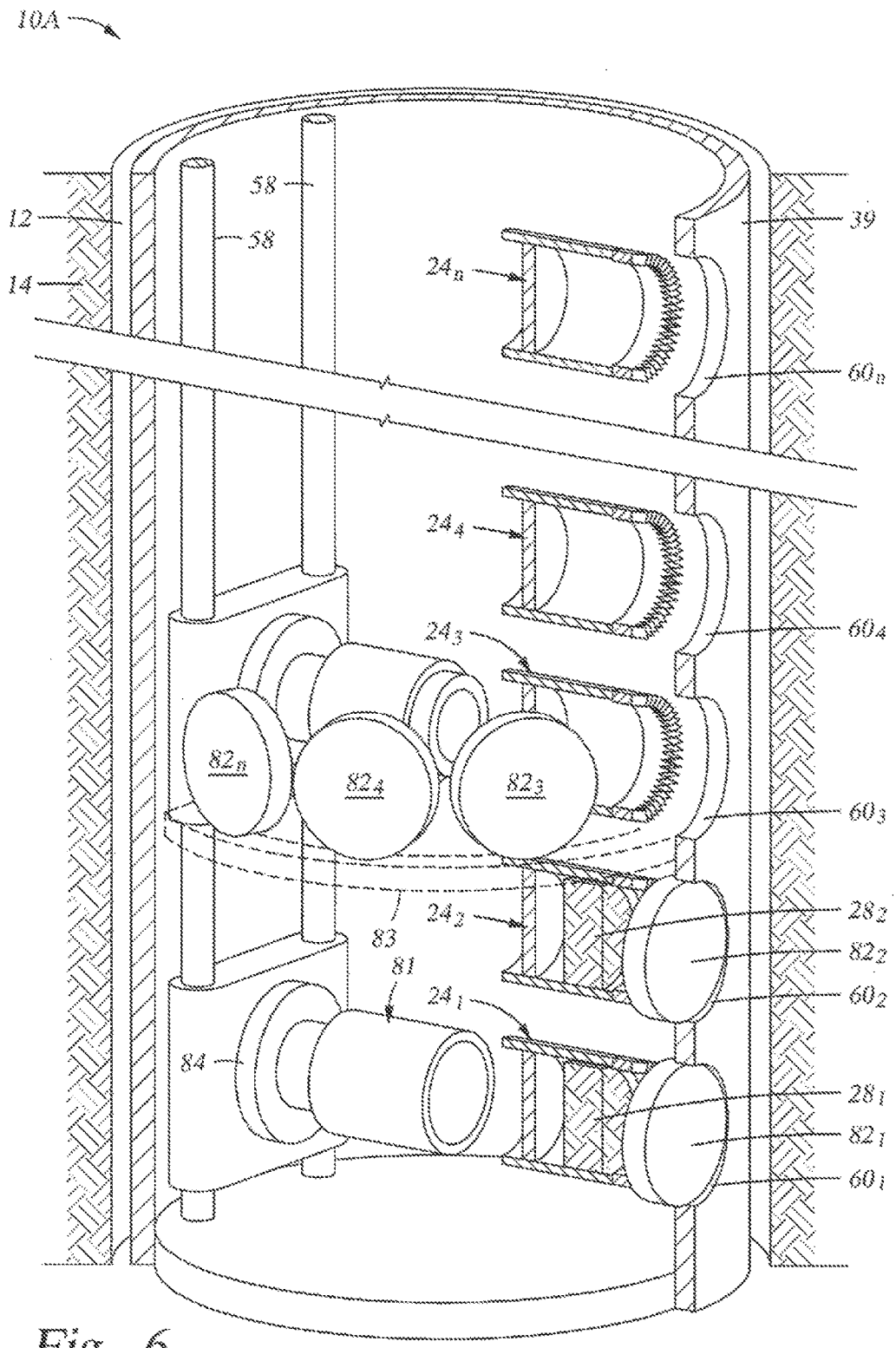
FIG. 6 is a perspective view of an embodiment of a coring system having a device for capping apertures formed in a housing of the coring system.

Shown in FIG. 6 is an alternate embodiment of a portion of coring system 10A and with coring bit assemblies $\mathbf{24}_{1-n}$ disposed within housing 39. Missing from the embodiment of coring system 10A is a pressure containment system for the coring bit assemblies $\mathbf{24}_{1-n}$. Instead, a cover deployment system 81 is shown and that is used for providing covers $\mathbf{82}_{1-n}$ over the respective apertures $\mathbf{60}_{1-n}$ formed though the sidewall of the housing 39. Cover deployment system 81 includes a rail assembly 83 on which covers $\mathbf{82}_{1-n}$ are mounted and arranged along a path that circumscribes the outer surface of housing 39. An urging means (not shown) selectively moves the covers $\mathbf{82}_{1-n}$ into position and registration with their respective aperture 60. Coupling of the covers $\mathbf{82}_{1-n}$ with apertures 60 can involve a threaded fitting, so that by rotating the covers $\mathbf{82}_{1-n}$, they can be inserted into apertures 60. In an alternative embodiment caps 65 (FIGS. 4A, 4B) may be provided with the cover deployment system 81, so that instead of covers the caps 65 can be attached to the coring bit assemblies $\mathbf{24}_{1-n}$ as described above.

Figure 7:
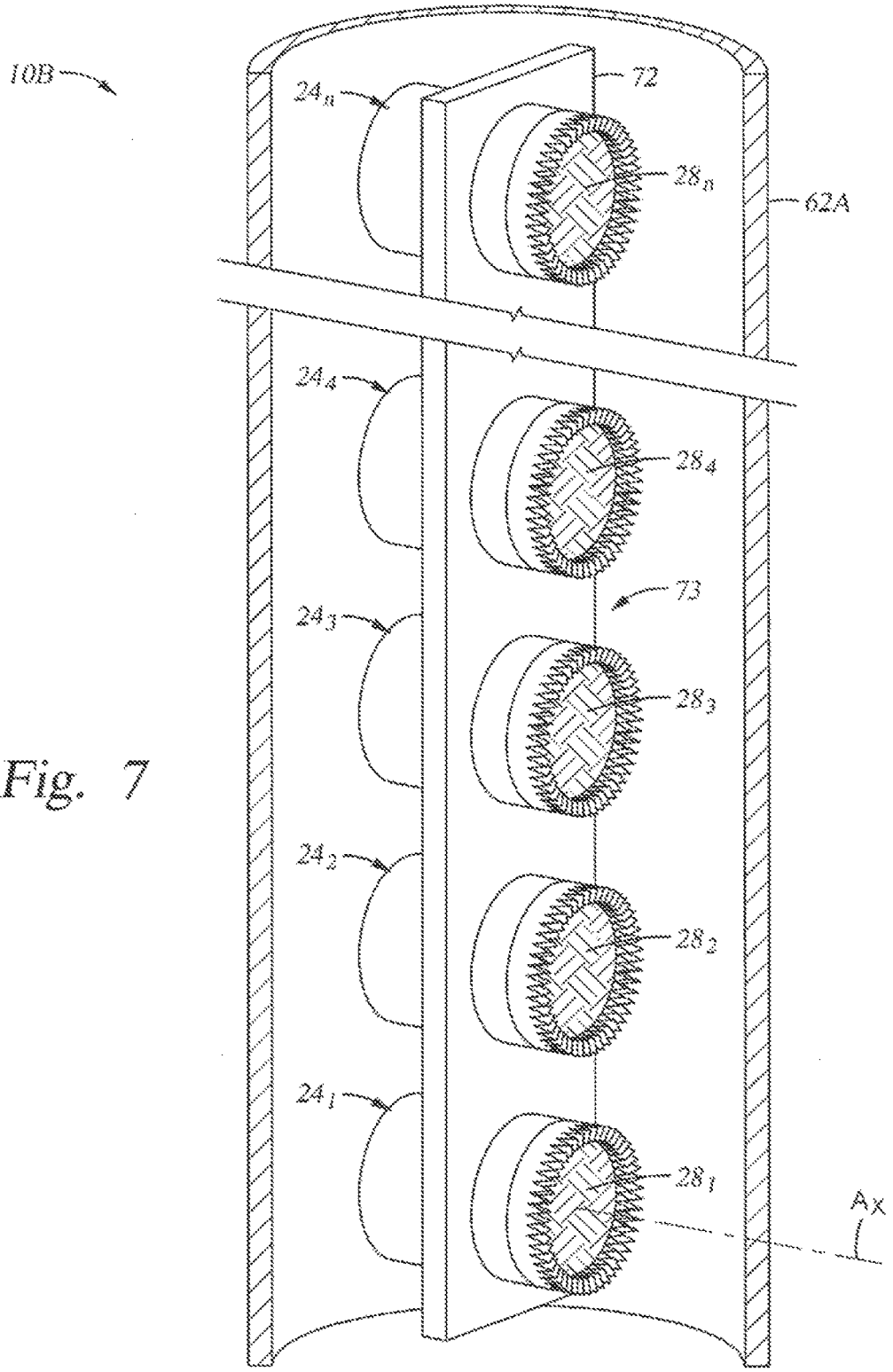
FIG. 7 is a perspective view of an alternate example of core sleeves with core samples being stored in a sealed container.

FIG. 7 illustrates in side perspective view an example of a series of the coring bit assembles $\mathbf{24}_{1-n}$ each holding a one of the sample cores $\mathbf{28}_{1-n}$. In this example, the coring bit assemblies $\mathbf{24}_{1-n}$ are disposed in a container 62A that is pressure sealed so that the sample cores $\mathbf{28}_{1-n}$ can be drawn to surface and analyzed. Here, a planar bracket 72 holds the coring bit assemblies $\mathbf{24}_{1-n}$ in a row within the container 62A to define a cartridge 73. In one example of operation, the coring bit assemblies $\mathbf{24}_{1-n}$ are slideable with respect to bracket 72 along a direction that is parallel to an axis $A_X$ of each of the coring bit assemblies $\mathbf{24}_{1-n}$. This allows the individual coring bit assemblies $\mathbf{24}_{1-n}$ to be moved radially outward from within the housing 39 (FIG. 2B) for gathering core samples $\mathbf{28}_{1-n}$ as described above. After the sample cores $\mathbf{28}_{1-n}$ are obtained with the coring bit assemblies $\mathbf{24}_{1-n}$, the cartridge 73 can be then moved axially within the coring system 10B from the housing 39, and into container 62A where they are stored under pressure.

Figure 8:
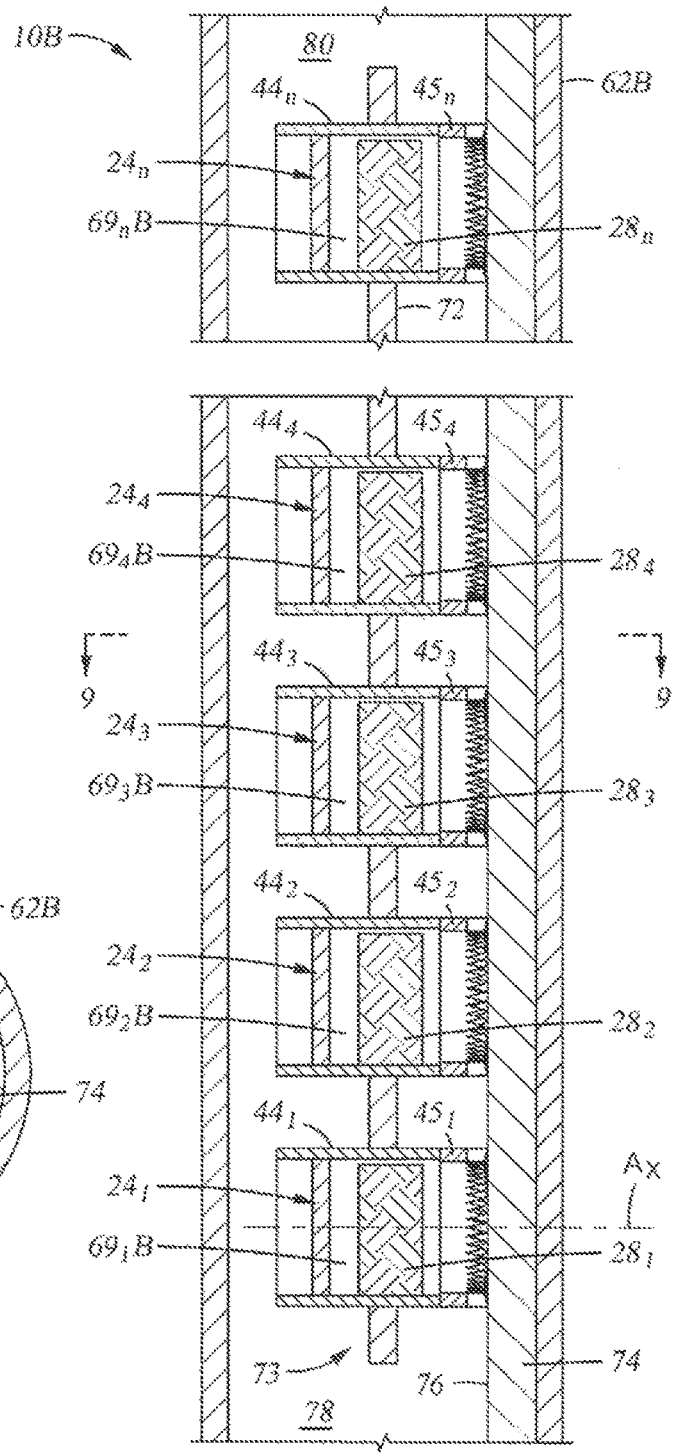
FIG. 8 is a side sectional view of an example of core sleeves with core samples being stored in a sealed container that has a coined surface.
Figure 9:
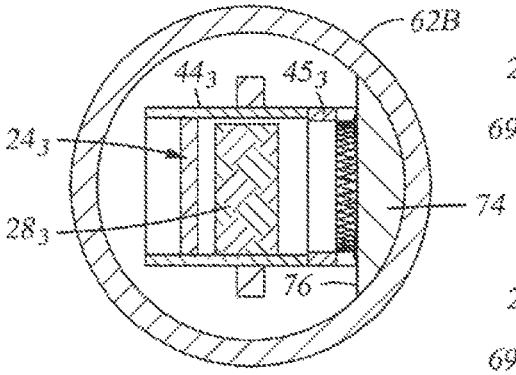
FIG. 9 is an axial sectional view of the container of FIG. 4 and taken along lines 9-9.

FIG. 8 shows an example of an example of a cartridge 73 that is made up of series of coring bit assemblies $\mathbf{24}_{1-n}$ wherein their respective sample cores $\mathbf{28}_{1-n}$ are stored at substantially the same pressure in the formation 14 (FIG. 1) from where the sample cores $\mathbf{28}_{1-n}$ were obtained. The cohesive structure of the cartridge 73 facilitates inserting coring bit assemblies $\mathbf{24}_{1-n}$ and sample cores $\mathbf{28}_{1-n}$ within container 62B and as a single unit. In this example, an inlay 74 is shown provided along an inner surface of container 62B and extending substantially along the length of container 62B and along a portion of its circumference. Optionally, however, the entire inner surface of container 62B may include inlay 74. In an example of operation of the embodiment of FIG. 8, the coring bit assembly $\mathbf{24}_1$ is the first to be used for obtaining sample core $\mathbf{28}_1$ and then the cartridge 73 is moved from within housing 39 and axially into container 62B a distance just far enough so that the open end of sleeve $\mathbf{44}_1$ and the cutting head $\mathbf{45}_1$ coring bit assembly $\mathbf{24}_1$ are in sealing contact, with inlay 74. Example materials for inlay 74 include materials that are pliable, and have a yield strength less than a yield strength of a material used for forming cutting head $\mathbf{45}_1$. In the illustrated example, the material of inlay 74 deforms and can provide a sealing surface to create a sealed space $\mathbf{69}_1$B-$\mathbf{69}_n$B within sleeve $\mathbf{44}_1$. As sample cores $\mathbf{28}_{1-n}$ at different depths or locations within wellbore 12 (FIG. 1) can be initially at different pressures, pressures in the different sealed spaces $\mathbf{69}_1$B-$\mathbf{69}_n$B can be different as well. In the example of FIG. 8, each of the coring bit assemblies $\mathbf{24}_{1-n}$ have been deployed to obtain their respective sample cores $\mathbf{28}_{1-n}$ and the cartridge 73 has been inserted fully into container 62B. As such, axially sliding cartridge 73 into container 62B, combined with a radial force to individually urge the coring bit assemblies $\mathbf{24}_{1-n}$ against inlay 74, creates a coined surface 76 along the outer surface of inlay 74. So that the coring bit assemblies $\mathbf{24}_{2-n}$ may maintain sealing contact with relay 74, the respective lengths of the sleeves $\mathbf{44}_{1-n}$ can increase in length with ascending order in which they are provided in the cartridge 73. For example, the axial length of sleeve $\mathbf{44}_n$ would be greater than any of the axial lengths of sleeves $\mathbf{44}_{1-4}$. Alternatively, the coring bit assemblies $\mathbf{24}_{1-n}$ may be staggered with respect to their position on bracket 72 to ensure their respective cutting heads $\mathbf{45}_{1-n}$ maintain a sealing contact with coined surface 76. Shown in an axial view in FIG. 9, which is taken along lines 9-9 of FIG. 8, depicts how cutting head $\mathbf{45}_3$ is urged into sealing contact with inlay 74. Alternatively, the lower portion 78 can be thinner and the upper portion 80 thicker.

Figure 10:
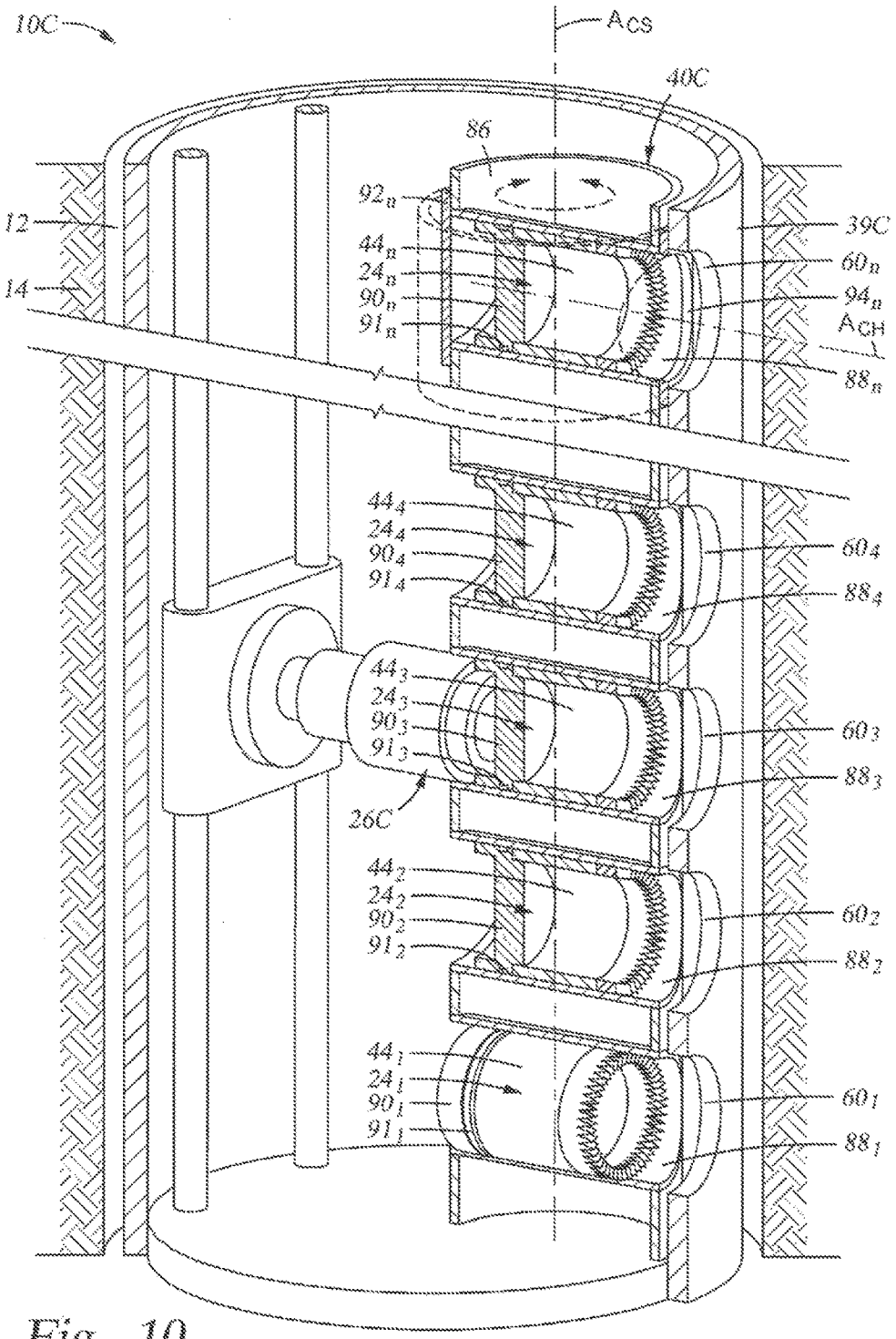
FIG. 10 is a perspective view of an alternate embodiment of a coring system having coring bit assemblies provided in a scalable chamber.

FIG. 10 is a perspective view of one example of an alternate embodiment of a coring system 10C wherein riser member 40C is made up of a core sleeve cylinder 86. In the illustrated example, core sleeve cylinder 86 is a substantially solid member, which can be formed from a composite, ceramic, or any type of metal, such as iron, steel, stainless steel, copper, alloys thereof, and the like. Further, a series of chambers 88 are formed transversely through core sleeve cylinder 86 at discreet, locations along the length of core sleeve cylinder 86. Embodiments exist wherein the axis $A_{CS}$ of cylinder 86 intersects each of the chambers $\mathbf{88}_{1-n}$. Coaxially disposal within each of the chambers $\mathbf{88}_{1-n}$ are pistons $\mathbf{90}_{1-n}$ wherein the pistons $\mathbf{90}_{1-n}$ are disk-like members. In the illustrated example, pistons $\mathbf{90}_{1-n}$ couple with the closed ends of the sleeves $\mathbf{44}_{1-n}$ of coring bit assemblies $\mathbf{24}_{1-n}$ shown coaxially inserted within chambers $\mathbf{88}_{1-n}$. Seals $\mathbf{91}_{1-n}$ circumscribe each of the pistons and provide a pressure and fluid barrier between the pistons $\mathbf{90}_{1-n}$ and the inner surfaces of chambers $\mathbf{88}_{1-n}$. The pistons $\mathbf{90}_{1-n}$ are fitted with a profile so that they may engaged by the coring bit assembly driver 26C as shown. More specifically, coring bit assembly driver 26C is engaging coring bit assembly $\mathbf{24}_3$ to urge it from within the core sleeve cylinder 86 and outside of housing 39C so that a core sample (not shown) may be gathered with the coring bit assembly $\mathbf{24}_3$. By providing the seals $\mathbf{91}_{1-n}$ around pistons $\mathbf{90}_{1-n}$, a separate dedicated seal system is not required for the embodiment of FIG. 10 or the rearward opening of cavities $\mathbf{88}_{1-n}$. In an example, collar 92 is shown circumscribing cavity $88_n$ and may be used for covering and sealing a forward opening that is formed where cavity $88_n$ intersects with the outer surface of core sleeve cylinder 86. Collar $92_n$ may include an opening $94_n$ that registers with the chamber $88_n$ so that the coring bit assembly $24_n$ may be deployed outside of the core sleeve cylinder 86. After a core sample (not shown) is retrieved by coring bit assembly $24_n$, the coring bit assembly $24_n$ can be drawn back into chamber $88_n$ and sleeve $92_n$ rotated with respect to core sleeve driver 86 and so that a solid portion of collar $92_n$ can cover the opening of the chamber $88_n$. In this fashion, sealed spaces may be formed within each of the chambers $88_{1-n}$ with respective collars. For the sake of clarity, collars are not shown associated with cavities $88_{1-4}$, however, embodiments exist wherein each of the chambers $88_{1-4}$ include a collar such as collar $92_n$ for creating a sealed space within those cavities $88_{1-4}$.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A system for obtaining core samples from a sidewall of a wellbore comprising:

a housing;

spaces in the housing;

pressure barriers selectively disposed between the spaces so that a pressure in each of the spaces is maintained at a particular value; and a coring bit assembly disposed in each one of the spaces that are spaced axially away from and between adjacent pressure barriers, each coring bit assembly comprising, a sleeve that selectively receives a one of the core samples, and a cutting head on an end of the sleeve that selectively is projected from the housing and into cutting engagement with the sidewall; and a coring driver in the housing that selectively engages an end of the sleeve distal from the cutting head and that is selectively moveable axially within the housing.

2. The system of claim 1, wherein the coring bit assemblies are arranged in a row that extends axially within the housing, and wherein the coring bit assemblies are moveable axially with respect to the coring driver.

3. The system of claim 1, further comprising a cylindrically shaped riser member in the housing, wherein the spaces are formed in the riser member, and wherein the coring bit assemblies with core samples are selectively disposed in the spaces.

4. The system of claim 3, wherein the riser member comprises a tubular with an axis that is substantially parallel with an axis of the housing, the riser member comprising, planar barriers provided between each adjacent coring bit assembly and that span across an inner circumference of the tubular to define pressure barriers, rear openings through which a coring driver is selectively inserted, and forward openings through which coring bit assemblies project through when the cutting head is in cutting engagement with the sidewall.

5. The system of claim 4, further comprising a container in which the riser member is selectively coaxially inserted, the container comprising an inner circumference with o-ring seals strategically located thereon, so that when the riser member is inserted into the container, at least one of the o-ring seals is between adjacent rear openings and adjacent forward openings.

6. The system of claim 3, wherein the riser member comprises a substantially solid cylindrical member having chambers transversely formed therein that are selectively pressure isolated from one another and wherein a one of the coring bit assemblies is disposed in each of the chambers.

7. The system of claim 6, further comprising a piston coaxially mounted in each of the chambers, and seals between the pistons and inner surfaces of the chambers that define a pressure barrier, wherein each of the pistons is coupled with an end of a coring bit assembly, so that when a coring bit assembly drive rotatingly and longitudinally motivates a one of the pistons, an attached coring bit assembly is urged out of the respective chamber and into coring engagement with the sidewall.

8. The system of claim 1, further comprising apertures in a sidewall of the housing through which the coring bit assemblies are inserted through, and a cover deployment system having threaded covers that are sealingly mounted over the apertures so that the space is pressure sealed.

9. The system of claim 1, further comprising a container, and a metal inlay disposed axially along a sidewall of the container, wherein the coring bit assemblies are disposed into the container so that the cutting heads are in sealing contact with the metal inlay, wherein the metal inlay is formed from a material having a yield strength that is less than a yield strength of a material making up the cutting heads, and wherein the spaces are formed as the cutting heads are urged into sealing contact with the metal inlay.

10. The system of claim 1, further comprising a cap inserted into an open end of the sleeve to define a pressure-seal for an inside of the sleeve, the cap comprising a circular base and walls circumscribing the base that project axially away from the base and abut an inward facing surface of the cutting head.

11. The system of claim 1, further comprising a cap inserted into an open end of the sleeve to define a pressure seal for an inside of the sleeve, the cap comprising a circular base and walls circumscribing the base that project axially away from the base and are threadingly coupled with an inner circumference of the cutting head.

12. The system of claim 1, wherein the particular value is substantially the same as a value of pressure in a subterranean formation from which the core sample was obtained.

13. A system for obtaining core samples from a sidewall of a wellbore comprising:

a housing;

an annular riser in the housing and that comprises a tubular and planar pressure barriers in the tubular;

spaces formed between adjacent pressure barriers in the riser, and that are selectively maintained at different pressures; and a coring bit assembly in each one of the spaces, the coring bit assemblies comprising annular cutting heads and sleeves having open ends coaxially affixed with the cutting heads, so that when the cutting heads are rotatingly and longitudinally urged into cutting contact with subterranean formation at the sidewall, core samples are formed and deposited into the sleeves and maintained in the sleeves at a pressure that is substantially the same as a pressure of the subterranean formation from which the core samples were taken.

14. The system of claim 13, wherein the spaces are formed in an annular riser member that is disposed in the housing, and wherein the riser member comprises a substantially solid cylinder with chambers transversely formed through the riser member.

15. The system of claim 14, further comprising pistons coaxially disposed in the chambers that couple with an end of each coring bit assembly, and seals between the circumference of each piston and an inner wall of each chambers, so that by rotatingly and longitudinally motivating a one of the pistons, a corresponding coring bit assembly is put into coring engagement with the sidewall for retrieval of a coring sample.

16. The system of claim 13, wherein the spaces are formed by sealing open ends of the sleeves with caps.

17. A method of obtaining core samples from a sidewall of a wellbore comprising:

providing a coring system comprising an elongated riser member that defines a housing, and coring bit assemblies disposed in the housing, each coring bit assembly having a cutting head and a sleeve;

using a one of the coring bit assemblies to gather a core sample;

storing the one of the coring bit assemblies and the core sample in the housing at a particular pressure;

using another one of the coring bit assemblies to gather another core sample;

storing the another one of the coring bit assemblies and the another core sample in the housing at another particular pressure; and inserting the elongated riser member into a container, and strategically providing seals at axial locations between the riser member and container, so that spaces formed transversely through the riser member are pressure isolated from one another.

18. The method of claim 17, wherein the one of the coring bit assemblies and the another one of the coring bit assemblies are disposed in chambers transversely formed through the riser member, the method further comprising providing pistons in ends of the chambers, coupling the pistons respectively to one of the coring bit assemblies and the another one of the coring bit assemblies, selectively rotating and longitudinally urging a one of the pistons to obtain a core sample.

19. The method of claim 17, wherein the step of storing comprises sealing open ends of the coring bit assemblies with caps.

* * * * *